US009091400B2

(12) United States Patent
Tso

(10) Patent No.: US 9,091,400 B2
(45) Date of Patent: Jul. 28, 2015

(54) MULTI-COLOR LIGHT EMITTING DIODE DEVICE

(71) Applicant: LUXO-LED CO., LIMITED, Hong Kong (HK)

(72) Inventor: Shih-Yang Tso, Taipei (TW)

(73) Assignee: LUXO-LED CO., LIMITED, Hong Kong (HK)

( * ) Notice: Subject to any disclaimer, the term of this patent is extended or adjusted under 35 U.S.C. 154(b) by 0 days.

(21) Appl. No.: 14/167,901

(22) Filed: Jan. 29, 2014

(65) Prior Publication Data

US 2014/0211464 A1 Jul. 31, 2014

Related U.S. Application Data

(60) Provisional application No. 61/758,631, filed on Jan. 30, 2013.

(51) Int. Cl.
*F21K 99/00* (2010.01)

(52) U.S. Cl.
CPC ... *F21K 9/50* (2013.01); *F21K 9/54* (2013.01); *F21K 9/56* (2013.01)

(58) Field of Classification Search
CPC ..... F21K 9/54; F21K 9/50
USPC ..... 362/249.02, 243, 231; 607/88, 94, 100; 606/1–3
See application file for complete search history.

(56) References Cited

U.S. PATENT DOCUMENTS

| | | | | |
|---|---|---|---|---|
| 7,229,467 | B2 * | 6/2007 | Spivak | 607/88 |
| 7,572,031 | B2 * | 8/2009 | Schultz et al. | 362/249.02 |
| 7,857,457 | B2 * | 12/2010 | Rutherford et al. | 353/31 |
| 7,960,706 | B2 * | 6/2011 | Ullman | 250/455.11 |
| 8,680,558 | B1 * | 3/2014 | Tischler | 257/98 |
| 2014/0211464 | A1 * | 7/2014 | Tso | 362/231 |

* cited by examiner

*Primary Examiner* — Anabel Ton
(74) *Attorney, Agent, or Firm* — Maschoff Brennan

(57) ABSTRACT

A multi-color light emitting diode device includes a plurality of light sources and a control module. The light sources are a Ultraviolet A light source, a Ultraviolet B light source, and a Ultraviolet C light source, a red light source, a green light source, and a blue light source, an infrared light source, and a YVA light source. The control circuit is configured with a plurality of control channels. Each of the control channels controls he respective light source to emit a light to generate a desired light combination.

4 Claims, 1 Drawing Sheet

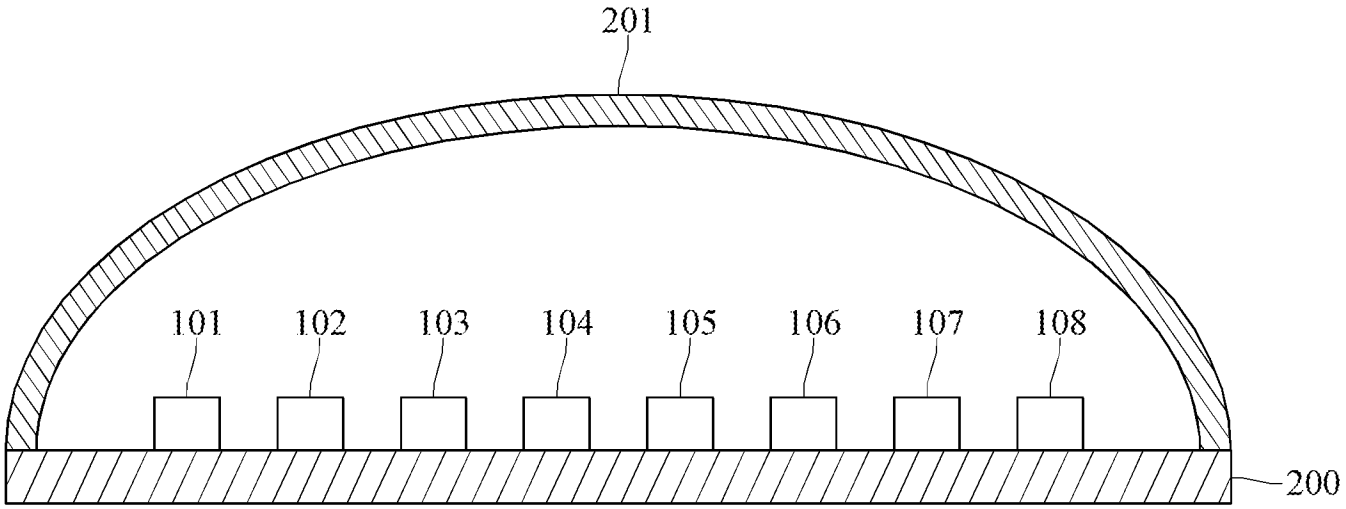
201
101
102
103
104
105
106
107
108
200

MULTI-COLOR LIGHT EMITTING DIODE DEVICE

CROSS REFERENCE TO RELATED APPLICATION

The application claims priority based on U.S. provisional application, Ser. No. 61/758,631, filed Jan. 30, 2013 entitled MULTI-COLOR LIGHT EMITTING DIODE DEVICE, which is hereby incorporated by reference in its entirely.

BACKGROUND

1. Technical Field

The disclosure relates to a multi-color light emitting diode device.

2. Related Art

A multi-color LED is an electronic device incorporating light-emitting diodes of more than one color. Each light-emitting diode produces a different color of light by running electricity through a semiconductor, and the different colors are then blended together to create the desired final color. Depending on the designs, multi-color LEDs can produce light by combining two, three, or four primary colors; these configurations are respectively called dichromatic, trichromatic, and tetrachromatic. The most common multi-color LED configuration, often called RGB, is trichromatic, with red, green, and blue diodes.

Besides multi-color LED, white-light LED illuminating devices have also been developed due to its light weight and low power consumption. There are three ways to generate white light via the LED. The first way is by mixing the tri-chromatic lights, i.e. the RGB lights. However, since the threshold voltages of the RGB light LEDs differ from each other, the required circuit to drive the LEDs is expensive and complicate. The second way to generate white light is using the phosphor. The third way to generate white light is forming a blue light LED on a ZnSe substrate. The blue light LED provides a blue light and the ZnSe substrate generates a yellow light. The white light is generated by mixing the blue light and the yellow light.

SUMMARY

The embodiment of the disclosure is related to a multi-color light emitting diode device. The device comprises a plurality of light sources and a control module. The light sources are a Ultraviolet A light source, a Ultraviolet B light source, and a Ultraviolet C light source, a red light source, a green light source, and a blue light source, an infrared light source, and a YVA (Yellow-violet-amber) light source. The control circuit is configured with a plurality of control channels. Each of the control channels controls he respective light source to emit a light to generate a desired light combination.

The detailed characteristics and advantages of the disclosure are described in the following embodiments in details, the techniques of the disclosure can be easily understood and embodied by a person of average skill in the art, and the related objects and advantages of the disclosure can be easily understood by a person of average skill in the art by referring to the contents, the claims and the accompanying drawings disclosed in the specifications.

BRIEF DESCRIPTION OF THE DRAWINGS

The present disclosure will become more fully understood from the detailed description given herein below for illustration only, and thus are not limitative of the present disclosure, and wherein:

FIG. 1 illustrates the multi-color light emitting diode device according to one embodiment of the disclosure.

DETAILED DESCRIPTION

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

The embodiment of the disclosure is related to a multi-color light emitting diode device. The device comprises a plurality of light sources and a control module. The light sources are a Ultraviolet A light source 101, a Ultraviolet B light source 102, and a Ultraviolet C light source 103, a red light source 104, a green light source 105, and a blue light source 106, an infrared light source 107, and a YVA light source 108.

The control circuit is configured with a plurality of control channels. Each of the control channels controls the respective light source to emit a light to generate a desired light combination. Each channel offers a tunable intensity. The control circuit may control the light sources to emit a light combination of white light or any desired color.

The Ultraviolet (UV) light is electromagnetic radiation with a wavelength shorter than that of visible light, but longer than X-rays, that is, in the range 10 nm to 400 nm, corresponding to photon energies from 3 eV to 124 eV. In the embodiment, the Ultraviolet A light source 101 emits a light having a wavelength of 400 nm to 315 nm, the Ultraviolet B light source 102 emits a light having a wavelength of 315 nm to 280 nm, and the Ultraviolet C light source 103 emits a light having a wavelength of 280 nm to 100 nm.

The Infrared (IR) light is also electromagnetic radiation with longer wavelengths than those of visible light, extending from the nominal red edge of the visible spectrum at 0.74 micrometers (μm) to 300 μm. In the embodiment, the infrared light source 107 emits a light having a wavelength of 0.74 μm to 300 μm.

In one embodiment, the light sources are disposed on a multi-layered substrate 200. In one embodiment, the multi-layered substrate is a ceramic substrate. According to the embodiment of the disclosure, the multi-layered substrate is designed to have high break down voltage.

In one embodiment, the device further comprises a reflector 201 to reflect at least one light from at least one of the light sources. In one embodiment, the reflector is sputtered with aluminum or gold. According to the embodiment of the disclosure, the reflector sputtered with aluminum or gold may have up to 92% reflection.

Further, by implementing the control circuit having a plurality of control channels, the light intensity of the device is tunable. Thus, the light of the sun having high CRI may be replicated. Further, the possibility to use a specific combination of wavelengths is also feasible through the lights source combination of the embodiment.

Note that the specifications relating to the above embodiments should be construed as exemplary rather than as limitative of the present invention, with many variations and modifications being readily attainable by a person skilled in the art without departing from the spirit or scope thereof as defined by the appended claims and their legal equivalents.

What is claimed is:

1. A multi-color light emitting diode device, comprising:

a substrate;

a Ultraviolet A light source on the substrate;
a Ultraviolet B light source on the substrate;
a Ultraviolet C light source on the substrate;
a red light source on the substrate;
a green light source on the substrate;
a blue light source on the substrate;
an infrared light source on the substrate;
a YVA (Yellow-violet-amber) light source on the substrate;
a reflector on the substrate, for reflecting light from at least one of the light sources, and the light sources being packaged between the reflector and the substrate; and
a control circuit having a plurality of control channels, each of the control channels controlling the respective light source to emit a light to generate a desired light combination.

2. The device according to claim 1, wherein the reflector is sputtered with aluminum or gold.

3. The device according to claim 1, wherein the substrate is a multi-layered substrate.

4. The device according to claim 3, wherein the multi-layered substrate is a ceramic substrate.

* * * * *